United States Patent [19]

Samuel et al.

[11] 4,109,794

[45] Aug. 29, 1978

[54] NECKTIE RACK

[76] Inventors: Stanley C. Samuel; Esta Samuel, both of 26 Wellsley Rd., Rockville Centre, N.Y. 11570

[21] Appl. No.: 722,528

[22] Filed: Sep. 13, 1976

[51] Int. Cl.[2] ..... A47F 7/12

[52] U.S. Cl. ..... 211/13; 211/48; 211/100

[58] Field of Search ..... 211/13, 48, 96, 97, 211/98, 99, 100, 101, 102, 116, 170, 171, 172, 173, 104, 195, 198, 204; 248/286, 291

[56] References Cited

U.S. PATENT DOCUMENTS

| | | | |
|---|---|---|---|
| 736,877 | 8/1903 | Reichert | 211/100 X |
| 2,179,677 | 11/1939 | Waine | 211/96 |
| 2,398,858 | 4/1946 | Rosenblatt | 211/96 |
| 2,428,454 | 10/1947 | Fowler | 211/104 |
| 2,470,015 | 5/1949 | Canner | 211/100 |
| 2,480,515 | 8/1949 | Smith | 211/104 X |
| 2,518,900 | 8/1950 | Kendall | 211/99 X |
| 2,529,403 | 11/1950 | Mack | 211/100 |
| 2,562,622 | 7/1951 | Laughlin | 211/100 |
| 2,665,011 | 1/1954 | Simsian | 211/99 |
| 2,706,049 | 4/1955 | Andrews | 211/104 X |

FOREIGN PATENT DOCUMENTS

| | | | |
|---|---|---|---|
| 484,171 | 6/1952 | Canada | 211/100 |
| 655,184 | 12/1928 | France | 211/99 |
| 321,662 | 3/1970 | Sweden | 211/100 |
| 727,416 | 3/1955 | United Kingdom | 211/100 |
| 534,481 | 3/1941 | United Kingdom | 211/99 |

*Primary Examiner*—Roy D. Frazier
*Assistant Examiner*—Thomas J. Holko
*Attorney, Agent, or Firm*—Roy C. Hopgood; John M. Calimafde; Charles W. Neill

[57] ABSTRACT

This necktie rack has one or more arms with hangers for individual ties extending from opposite sides of each arm. Each of the arms swings forward and upward about a pivot to bring the hangers into position for convenient removal and replacement of ties; and each arm extends forward toward its lower end, when at rest, to leave space under each hanger for the necktie of that hanger to extend downward without interference with or from other ties. Features of the mechanical construction make the rack economical to manufacture and attractive in appearance.

4 Claims, 4 Drawing Figures

NECKTIE RACK

BACKGROUND AND SUMMARY OF THE INVENTION

It is advantageous to keep neckties together on a rack when not in use. A necktie rack keeps the ties neat and unmussed; it keeps individual ties from being misplaced or lost; and it locates ties in positions for making a choice for use with a particular suit.

The usual objection to the use of necktie racks is that they are bulky and take up too much space on a closet door or other location; but most of all, such racks are not used because it is inconvenient to use them. Often it is difficult to put the ties on the rack or to remove them. Ties at the front interfere with removal of ties behind them, and often obstruct the vision so that selections cannot be made without removing a number of ties and then replacing all but the one which is selected. The interference of ties with one another on a rack can be overcome by providing greater clearances between the hangers, but this has been difficult to do without making the necktie racks objectionably large and bulky for the number of ties that can be placed in them.

This invention provides a necktie rack in which neckties are supported from individual hangers with the space below each hanger unobstructed, so that a necktie can hang freely from the hanger without interference from other neckties; but at the same time the neckties are, when stored on the hanger, as close together as they can be; that is, immediately adjacent to one another so as to occupy a minimum of space. Arms that support the necktie hangers of this invention are pivoted to a main support so that each arm can swing forwardly and upwardly into a substantially horizontal position, so that the spacing between the neckties becomes larger and the neckties can be conveniently removed and replaced; and can also be inspected before removing a selected tie from the rack.

The preferred embodiment has a plurality of arms, so that successive sections of the rack can be operated to bring ties into position for inspection and removal or replacement without requiring that the hangers for all of the ties be pulled forward and upward at the same time. For necktie racks of relatively small capacity, a single arm is sufficient; but for racks of larger capacity, it is a distinct advantage to be able to bring selected groups of ties into dispensing and replacing position without having to disturb the other ties in the rack.

The invention also includes mechanical features which make the necktie rack particularly convenient to operate and economical to manufacture.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
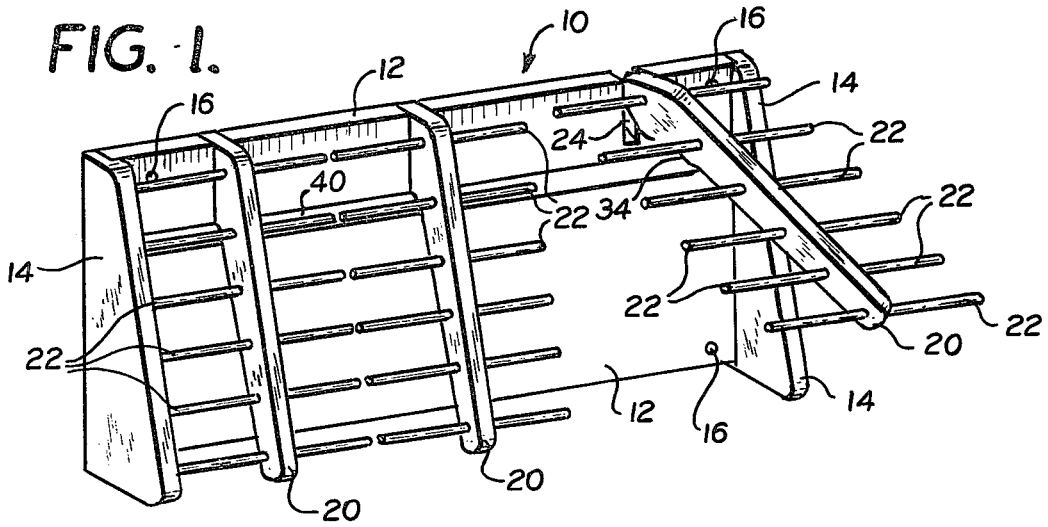
FIG. 1 is an isometric view of a necktie rack made in accordance with this invention and showing one arm of the rack swung forwardly and upwardly for convenient removal or replacement of neckties from the hangers of that arm.

FIG. 1 shows a tie rack, indicated generally by the reference character 10, and including a back element 12 and end plates 14 secured to opposite ends of the back element 12. There are openings 16 extending through the back element 12 for receiving screws by which the necktie rack can be supported from a door or other vertical surface.

There are three arms 20 which are pivotally connected at their upper ends with the back element 12 and these pivot connections will be explained more fully in connection with FIG. 3. There are individual tie hangers 22 extending from opposite sides of each of the arms 20; and neckties are draped over these tie hangers 22. The right-hand arm 20 is shown in FIG. 1 swung forwardly and upwardly about its pivot connection to the back elements 12 for convenient removal of neckties from the hangers 22, or placement of the neckties on the hangers.

The arms 20 will remain in the forward upward position of the right-hand arm in FIG. 1 only so long as they are held there by a hand of a person using the tie rack. Whenever an arm 20 is released, it swings downward, by gravity, into the positions of the center and left-hand arms 20 of FIG. 1. In these downward positions, the arms 20 have their upper ends in substantial alignment with the forward end of the end plates 14, so that the tie rack, when viewed from either end, has the arms 20 and the portions of the neckties which are draped over the tie hangers 22 hidden by the end plates 14.

Figure 2:
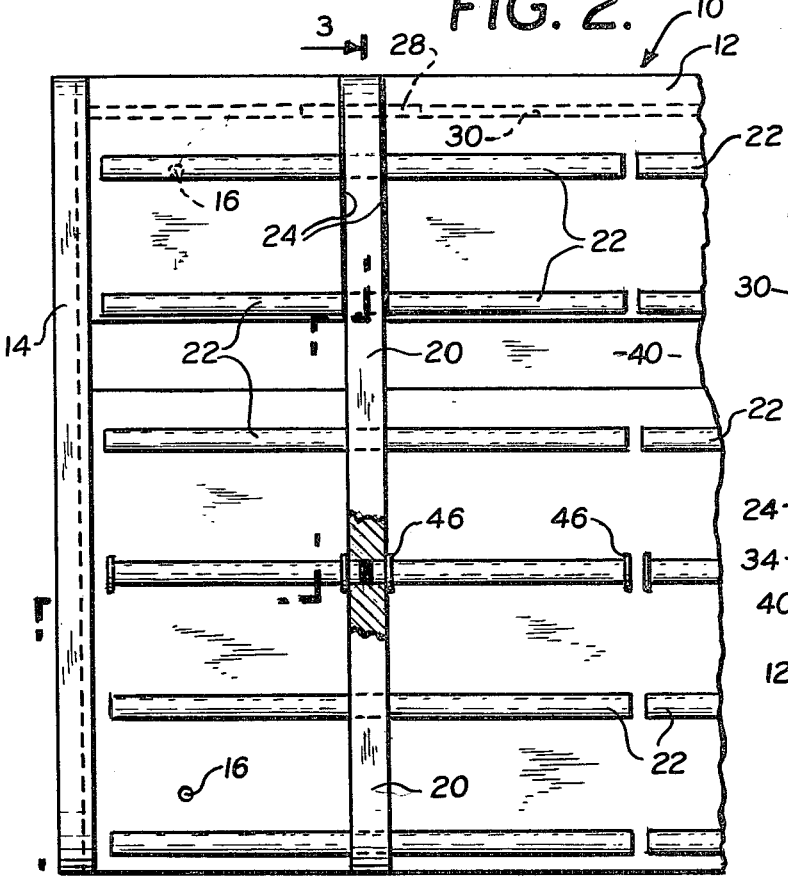
FIG. 2 is an enlarged front elevation of a portion of the necktie rack shown in FIG. 1.
Figure 3:
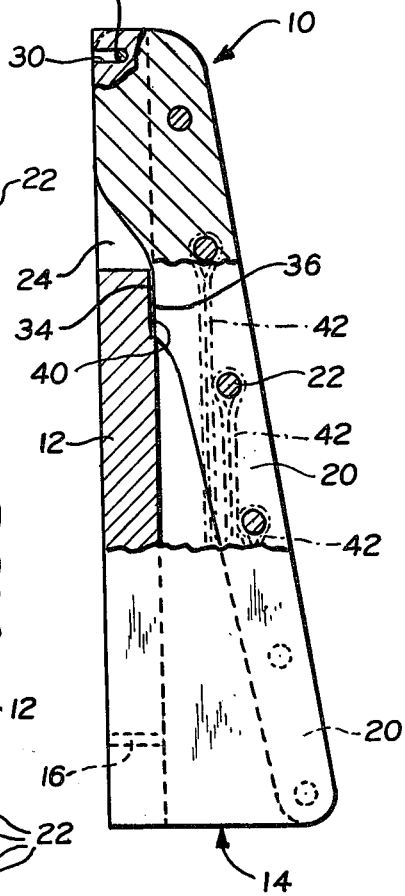
FIG. 3 is a view taken on the line 3—3 of FIG. 2.

The upper portion of each arm 20 extends into a channel 24 which opens through the front face of the back element 12, as shown in FIG. 2 and 3. The width of the arm 20 is slightly narrower than the width of the channel 24, so that the arm 20 fits in the channel 24 with a running fit.

A pivot pin 28 extends through the upper part of the arm 20 and projects from both sides of the arm, as shown in FIG. 2. There is a groove 30 in the back surface of the back element 12, as shown in FIG. 2.

When the arm 20 is assembled with the back element 12, the arm is inserted into the top of the channel 24 with the pivot pin 28 above and behind the back element 12. The arm 20 is then lowered until the pivot pin 28 comes into line with the groove 30; and the arm 20 is moved forward to bring the pivot pin 28 into the groove 30 and as far forward in the groove as the groove extends, as shown in FIG. 3.

The arm 20 is then swung about the pivot pin 28, in a clockwise direction, until a contact surface 34 of the arm comes against a bumper surface 36 on the front surface of the back element 12 just below the channel 24. In the construction illustrated, there is a strip 40 of soft material adhered to the bumper surface 36, so that any time an arm 20 is dropped against the bumper surfce 36, the lining 40 will eliminate any noise.

FIG. 3 shows neckties 42 in broken lines and illustrates the way in which the ties hang close together, when the arm 20 is in its lowered position. The tie hangers 22 have their axes in a plane parallel to the front surface of the arm 20; but the bumper 36 stops the descent of the arm 20 before it reaches a vertical position. The arm 20 slopes outwardly toward its lower end, so that the space below each of the tie hangers 22 is unobstructed and room is provided for a tie 42 to hang straight down from the hanger by which it is supported.

Figure 4:
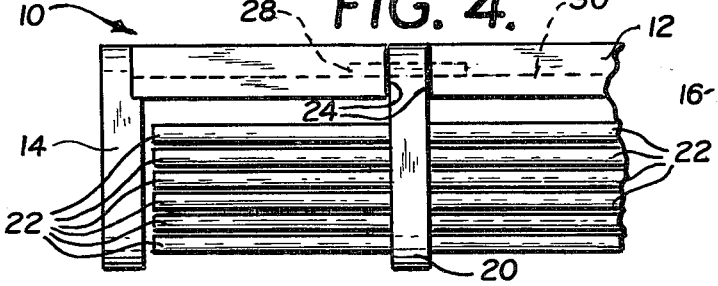
FIG. 4 is a fragmentary, top plan view of a part of the structure shown in FIG. 2.

This offsetting of each of the tie hangers 22 is shown in FIG. 4, which is a plan view looking down on the tie rack with the arm 20 in the position shown in FIG. 3.

FIG. 4 also shows the depth of the groove 30 and the way in which the pivot pin 28 of the arm 20 rests against the inner end of the groove 30.

The pivot pin 28 cannot come out of the groove 30 when the arms 20 are in lowered position, as will be apparent from FIG. 3. It will also be apparent that any force applied to the bottom of the arm 20, to swing it outward and upward about the pivot 28, tends to pull the pivot 28 against the inner end of its groove 30. Thus there is no occasion, during the use of the tie rack, when any rearward force is exerted against the pivot pin 28. It is unnecessary, therefore, to have any retaining means for holding the pivot 28 in its groove 30.

The tie hangers 22 may be rods which are pushed through openings in the arm 20. The preferred construction is shown in FIG. 2, where the view is a sectional view through the arm 20 at the third tie hanger from the bottom of the figure. Each tie hanger is preferably a dowel with a flange 46 at each end. The part of the dowel that extends into the arm 20 is of substantially the same diameter as the opening into which it is inserted, and it fits with a tight fit. Flange 46 limits the extent to which the tie hanger can be inserted into the arm 20, so as to leave space for inserting another tie hanger from the other side of the arm. A flange 46 at the end of the tie hanger 22, remote from the arm 20, prevents neckties from sliding off of the tie hanger accidentally. Each of the tie hangers is preferably made of birch wood. In order to simplify the drawing, the flanges 16 are shown only on the tie hangers which extend into the part of the arm 20 which is shown in section in FIG. 2. It will be understood, however, that all of the tie hangers are preferably of the same construction with flanges 46 and with their end portions secured to the arm 20 by a press fit into the opening through the arm.

An outstanding advantage of the tie rack of this invention is that the neckties 42 (FIG. 3) are hung as close together as they can be hung when the arms 20 are in their lowered positions. This has the advantage that the tie rack takes up a minimum of space. It would have the disadvantage that neckties would be difficult to remove from the tie rack without disturbing other neckties; but when any one of the arms 20 is swung outward and upward, as in the case of the right-hand arm 20 in FIG. 1, the neckties move further apart, since the vertical spacing of the tie hangers in FIG. 3 becomes a horizontal spacing with the arm 20 swung outward, as shown in FIG. 1. This leaves the ties spaced from one another, so that any tie be removed from the tie rack without interference with or by any other necktie.

The preferred embodiment of the invention has been illustrated and described but changes and modifications can be made and some features can be used in different combinations without departing from the invention as defined in the claims.

What is claimed is:

1. A necktie rack including in combination a back element, an arm supported at its upper end from the back element, a pivot connection between the top of the arm and the back element on which the arm swings about a horizontal axis to move angularly with respect to the back element toward and from a horizontal position in which the arm extends forward, tie hangers carried by the arm and extending generally horizontally from both sides of the arm at spaced locations lengthwise of the arm, and bumper surfaces at the upper part of the arm and limiting downward angular movement of the arm to a position of rest extending outward at an acute angle to the back element in a position where each of the spaced tie hangers is at a different horizontal spacing forward from the back element with the lowermost tie hanger furthest from the back element so that ties on the hangers have space below them, when the arm is against the back element bumper surface, into which each tie can hang freely and vertically with its front and back inside surfaces in direct confrontation with one another and without substantial interference from other ties on other tie hangers, characterized by the back element having a channel opening through the top of the back element and extending for the full front-to-back thickness of the back element at the upper part of the back element, the upper end of the arm extending into the channel, and the pivot connection between the arm and the back element being pins extending from opposite sides of the arm and into bearing surfaces in the opposite sides of said channel and characterized by the back element being a board of substantial front-to-back thickness, and the channel extending for a substantial distance downward from a top of the board, the upper end of the arm being of a width that fits into the channel with a running clearance so that the arm is held against transverse movement by the sides of the channel, the pins that extend from the arm to the sides of the channel being a pin that extends from both sides of the arm and into the sides of the channel on opposite sides of the arm, the board having a groove in a rearward face thereof and of a width for receiving the portions of the pin that extend beyond the sides of the arm, said groove being of a depth less than the front-to-back thickness of the back board whereby the end of the groove provides a bearing surface that limits forward movement of the pivot pin and the arm when the arm is in its downwardly and forwardly extending position with said bumper surfaces in contact with one another, one of the bumper surfaces being on the back of the arm immediately below the lower limit of the channel when the arm is in contact with the other bumper surface which is part of the front surface of the back element below the bottom of said channel, the portion of the arm extending below the channel and pressing against the forward surface of the back board being in position to hold the pivot from moving rearwardly in the groove and the force exerted by a person swinging the arm outward at its lower end serving to hold the pins at the forward end of the groove whereby the axes of the pin remains at the forward end of the groove for all working positions of the arm.

2. The necktie rack described in claim 1 characterized by there being a plurality of arms spaced from one another across the width of the back board and spaced so that adjacent tie hangers of different arms have horizontal clearance from one another, each arm having pairs of tie hangers with the hangers of each pair projecting in opposite directions from the sides of the hanger, a different channel extending down from the top of the back board for each of the arms and into which the arm extends, each arm having a rearward surface immediately below the channel into which the arm extends and being shaped to contact its bumper surface with the bumper surface on the front of the back board immediately below the channel to limit downward swinging movement of the arms to angular positions where each of the spaced pairs of tie hangers on each arm is at different horizontal spacing forward from the back element with the lowermost pair of tie hangers furthest from the back element so that ties on the hangers have space below them, when the arm is against the back element bumper surface, into which each tie can hang freely and vertically with its front and back inside surfaces in direct confrontation with one another and without interference from other ties on other tie hangers.

3. A necktie rack including in combination a back element, an arm supported at its upper end from the back element, a pivot connection between the top of the arm and the back element on which the arm swings about a horizontal axis to move angularly with respect to the back element toward and from a horizontal position in which the arm extends forward, tie hangers carried by the arm and extending generally horizontally from both sides of the arm at spaced locations lengthwise of the arm, and bumper surfaces at the upper part of the arm and limiting downward angular movement of the arm to a position of rest extending outward at an acute angle to the back element in a position where each of the spaced tie hangers is at a different horizontal spacing forward from the back element with the lowermost tie hanger furthest from the back element so that ties on the hangers have space below them, when the arm is against the back element bumper surface, into which each tie can hang freely and vertically with its front and back inside surfaces in direct confrontation with one another and without substantial interference from other ties or other tie hangers, stationary end plates at opposite ends of the back element and secured thereto and that have rearward edge portions corresponding to the shape of the back element at the region of contact and that have forward ends corresponding generally to the downward and forward slope of the arms when the arms are in their downward positions of rest, said end plates concealing end views of the tie hangers and the portions of neck ties draped over the hangers and located above the level of the bottom of the arms when the arms are in their lowermost position, said end plates having bottom surfaces defining the lowermost surfaces of the rack such that the tie rack can be stably supported on a table.

4. The necktie rack described in claim 3 characterized by the back element of the tie rack having a surface of a vertical extent corresponding to that of the end plates and that bears against a wall or other vertical surface on which the tie rack is hung when in use.

* * * * *